US006100651A

United States Patent [19]

Ohtsuka

[11] Patent Number: 6,100,651

[45] Date of Patent: Aug. 8, 2000

[54] FLUORESCENT LAMP STABILIZER HARMONICS REDUCTION METHOD

[75] Inventor: Hitoshi Ohtsuka, 13-1 Kandakonya-Cho, Chiyoda-Ku, Tokyo 101, Japan

[73] Assignee: Hitoshi Ohtsuka, Tokyo, Japan

[21] Appl. No.: 07/891,671

[22] Filed: May 29, 1992

Related U.S. Application Data

[63] Continuation of application No. 07/339,305, Apr. 17, 1989, abandoned.

[51] Int. Cl.[7] ..... H05B 41/16

[52] U.S. Cl. ..... 315/279; 315/282; 315/DIG. 5; 315/307

[58] Field of Search ..... 315/276, 277, 315/279, 282, DIG. 5, DIG. 4, 278, DIG. 2, 291, 297, 307, 219, 223, 224

[56] References Cited

U.S. PATENT DOCUMENTS

| | | | |
|---|---|---|---|
| 4,185,233 | 1/1980 | Riesland et al. | 315/DIG. 5 X |
| 4,399,391 | 8/1983 | Hammer et al. | 315/DIG. 5 X |
| 4,441,054 | 4/1984 | Bay | 315/DIG. 4 X |
| 4,559,479 | 12/1985 | Munson | 315/239 |

OTHER PUBLICATIONS

Pp. 1706–1708, *Von Nostrand's Scientific Encyclopedia*, D. Van Nostrand Company, Princeton, NJ (3d ed. 1958).

Pp. 557, *IEEE Standard Dictionary of Electrical and Electronic Terms*, IEEE. Inc., New York, NY (2d ed. 1977).

Chapter 13, *Reference Data for Engineers: Radio, Electronics, and Communications*, Howard W. Sams & Co., Indianapolis, IN (7th ed. 198.

*Primary Examiner*—Ali Neyzari

*Attorney, Agent, or Firm*—Fulwider, Patton, Lee & Utecht, LLP

[57] ABSTRACT

A method for reducing the harmonics created by rapid-start fluorescent lamp stabilizer balance systems is accomplished by increasing the number of turns of the secondary winding of the transformer so as to decrease the secondary current to approximately 40 to 90 percent of the rated lamp current. This method increases the impedance and reduces the secondary current between 40 and 90 percent of the rated lamp current. While the absolute value of the illuminous intensity is lowered by the reduction in the secondary current, the lamp maintains a uniform brightness of illumination. This method decreases the distortion in the primary wave form which decreases the distortion effect on sensitive electronic systems which may be connected to the same electrical power source or may be in the area near the stabilizer.

11 Claims, 5 Drawing Sheets

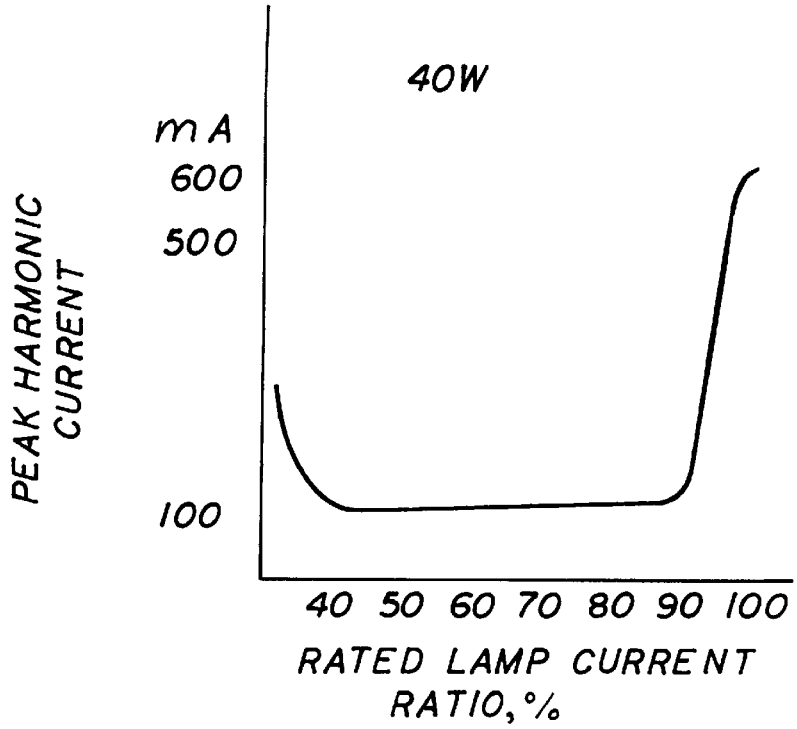
FIG. 1
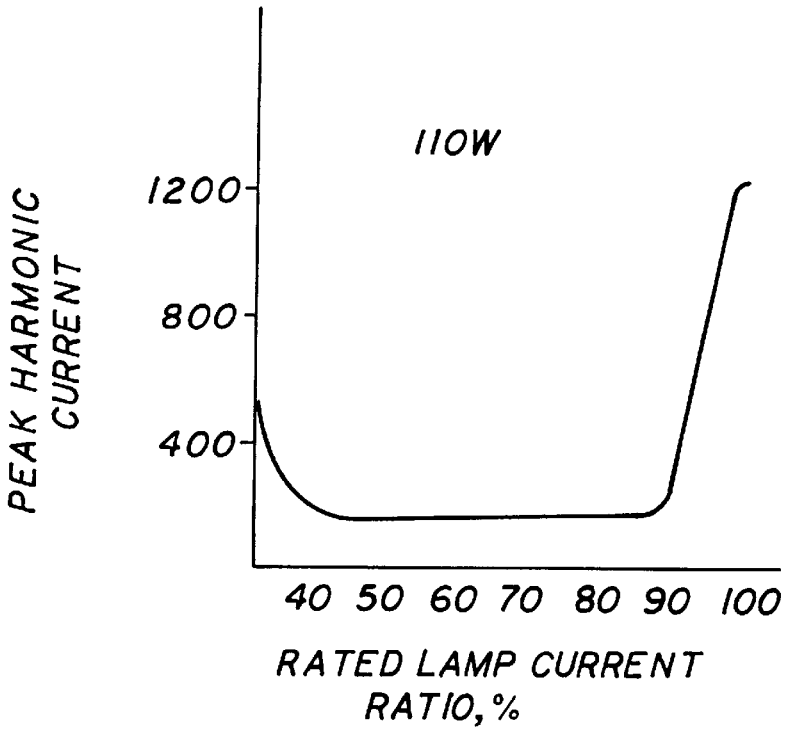

FLUORESCENT LAMP STABILIZER HARMONICS REDUCTION METHOD

This application is a continuation, of application Ser. No. 07/339,305, filed Apr. 17, 1989 now abandoned.

FIELD OF THE INVENTION

This invention relates to fluorescent lamp starter systems and more particularly to a method for reducing the harmonics created by rapid start fluorescent lamp stabilizer ballast systems.

BACKGROUND OF THE INVENTION

Fluorescent lamps are conventionally started by inducing a high voltage generated by a coil in the starting circuit and then stabilizing the illumination by suppressing the abnormally high current developed in the fluorescent tube after the lamp is lit and stabilized. As the consumption of energy became more critical, new techniques were developed to save energy consumed during the start up method which previously was highly energy inefficient compared to the power consumption of the fluorescent lamp once it was lit. These energy saving systems included the low power consumption type of fluorescent lamp stabilizers which incorporated a phase control method to save power. However, in a stabilizer utilizing the phase control method of the prior art, harmonics can develop in the secondary current side of the windings due to a distortion in the current wave form. This distortion can produce a variety of magnetic wave interference effects which could be propagated over substantial distances and can affect various types of electrical components such as communication systems, cellular telephones, and systems that rely on radio frequency transmissions. Furthermore, distortion effects in the current wave form of the primary side of the ballast winding has created problems effecting the power source of the fluorescent light and any other equipment which is connected to it. Another undesirable effect of the wave form distortion is the increased temperature resulting in the stabilizer which is brought about by heat created by the harmonic wave forms. As a result the life of the stabilizer can diminish because of the increased temperature caused by this distortion of the current wave form in the windings. Thus, there remains a need for improved low powered fluorescent lighting methods which avoid the harmonics and distorted wave forms created by previous systems.

SUMMARY OF THE INVENTION

The reduction of undesired harmonics and wave form distortion in fluorescent lamp stabilizers is highly desireable since such a method will assist in the prevention of magnetic wave interference deterioration of the insulation of the ballast and increase reliability of the stabilizer due to a lower operating temperature. Additionally, decreased distortion in the primary wave form will diminish the effect that such distortion will have on sensitive electronic systems connected to the same electrical power source. The present invention produces these desirable results and at the same time retains a low power consumption during the fluorescent lamp start up and operation. The present invention features the reduction of harmonics through a reduction in the peak current value while avoiding the distortion of the secondary current of the ballast system. The invention accomplishes this desirable result by increasing the number of turns of the secondary winding of the transformer so as to decrease the secondary current to approximately 40 to 90 percent of the rated lamp current in the rapid start type lamp stabilizer, thereby, almost completely eliminating the peak current value and reducing harmonics without disturbing the secondary current wave form. The invention thus increases the impedance and reduces the secondary current to between 40 and 90 percent of the rated lamp current. At the same time the function of the rapid start system is maintained as the filament voltage is still kept at approximately 3.8 volts to sustain the effective operation of the lamp. By this method, the absolute value of the luminous intensity is lowered somewhat by reducing the secondary current, but the uniform brightness of the lumination is maintained. From the above it may be seen that the present invention provides an improved method of starting fluorescent lights which reduces harmful harmonics and primary wave form distortion while at the same time maintaining adequate luminosity and starting characteristics. Other benefits and advantages of the present invention will be evident to those skilled in the art from the following detailed description, taken in conjunction with the accompanying drawings, which illustrate by way of example, the principles of the invention.

BRIEF DESCRIPTION OF THE DRAWINGS

FIG. 1 illustrates the relationship between the harmonic wave peak current value and the rated lamp current ratio for the invention.

DETAILED DESCRIPTION

The present invention obtains the desirable results of reducing harmonics developed in the secondary current side due to the distortion in the current wave form in the primary side of prior art rapid start fluorescent starter system. Thus, the present invention not only gives the benefits of reducing the interference of such starter systems with radio frequency transmissions in the vicinity but also decreases interference with other electronic systems using the same line and reduces the temperature at which the ballast runs due to a reduction in the distortion of the primary current wave form. The present invention provides a novel method which accomplishes this beneficial result by increasing the number of turns of the secondary winding of the transformer so as to decrease the secondary current to approximately 40 to 90 percent of the rated lamp current in the rapid start type fluorescent lamp stabilizer. This reduction in secondary current almost completely eliminates the peak current value and reduces the harmonics produced without disturbing the secondary current wave form.

FIG. 1 illustrates the relationship of the harmonic wave peak current value and the rated lamp current ratio. As this drawing illustrates, the harmonics for the peak current are substantially increased at the ends of the rated lamp current ratio. If the lamp current ratio is reduced from between 40 and 90 percent, the distortion current peak produced is substantially reduced thereby avoiding the problems created by harmonic distortion in both the primary and secondary circuits and the propagation of such distortion in the form of radio frequency interference to the surrounding area.

Figure 2:
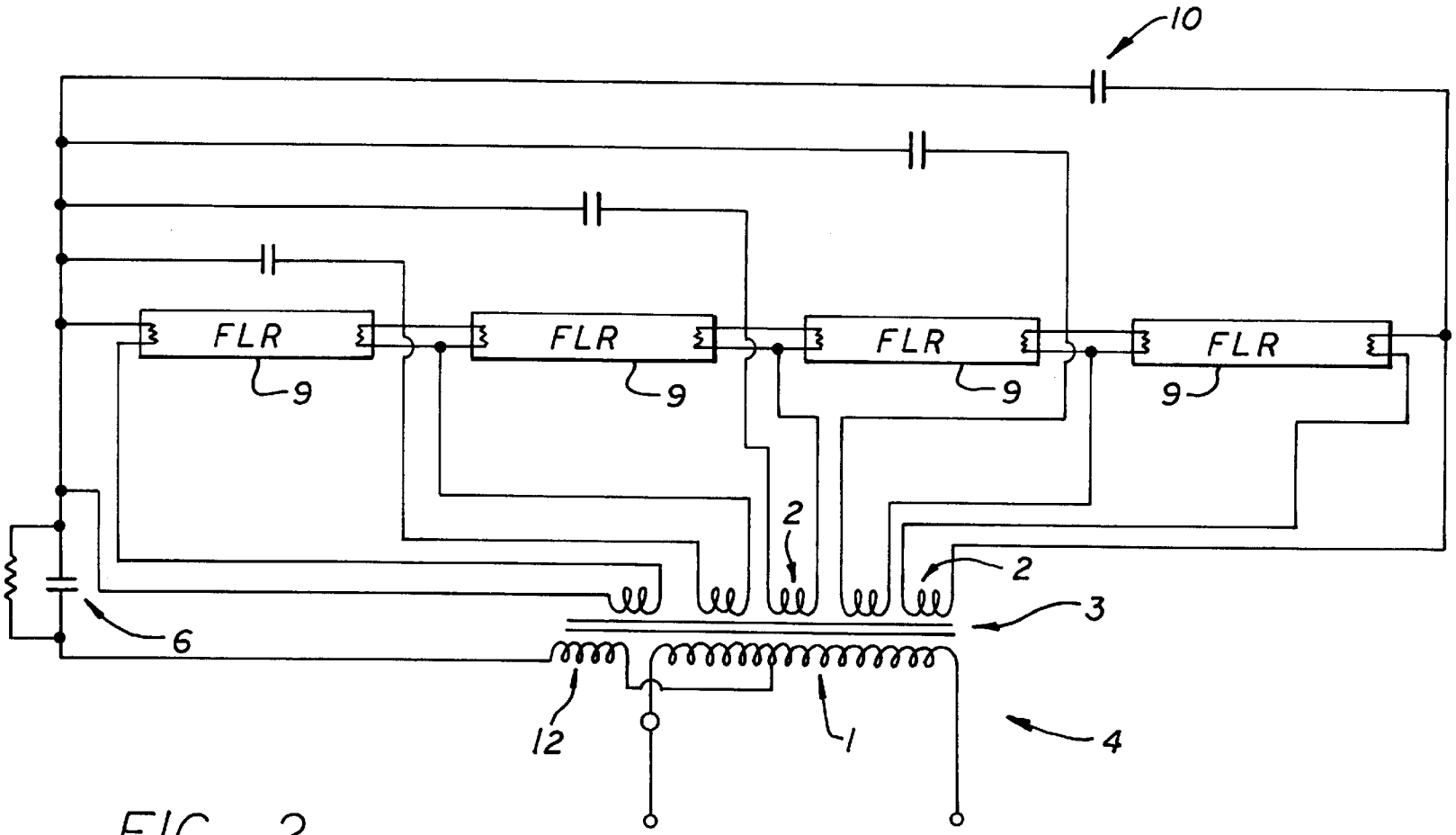
FIG. 2 is a circuit diagram of the basic fluorescent lamp stabilizer of the type which may be adapted to use the invention.

FIG. 2 is an illustration of the circuit diagram of a typical fluorescent lamp stabilizer to which the present invention may be applied. The particular stabilizer illustrated is a four lamp type utilizing a fluorescent lamp 9. As can be seen in FIG. 2, the transformer 4 includes a magnetic core, a primary winding 1, and a transfer coil 12 directly coupled with the primary winding. A plurality of heating windings 2 are also inductively coupled with the primary winding 1 to supply heating current to the lamp filaments of the fluorescent lamps 9. The circuit includes a capacitor 6 connected at one side of the transfer coil 12 and to one side of the fluorescent lamps to provide a leading current in the secondary circuit side. A pair of terminals are provided for connection to a suitable alternating circuit supply (not shown) which can be, for example, a 110 volt or 120 volt AC supply. When the primary power is switched on the secondary voltage is applied to both ends of the fluorescent lamp 9 and when the electron discharge from the electrode becomes sufficient after the filament becomes heated, discharges occur within the fluorescent lamp 9 between the ungrounded electrode and the ground, normally a metal reflector, which spreads through the entire tube becoming a complete primary discharge. The filament of the fluorescent lamp 9 is constantly heated by the secondary current of the transformer 4. A condenser 10 is used to prevent unwanted noise being propagated from the circuit, although in common usage the lamp current is normally between 415 and 435 miliAmps for the 40 watt rapid start type and 800 miliAmps for the 110 watt rapid start type. The present invention increases the number of turns of the secondary coil winding thereby increasing the impedance and reducing the secondary current to between 40 and 90 percent of the rated lamp current. Thus, the function of the rapid start type is maintained as the filament voltage is kept at 3.8 volts plus or minus 0.4 volts even when the secondary current is reduced.

Figure 3:
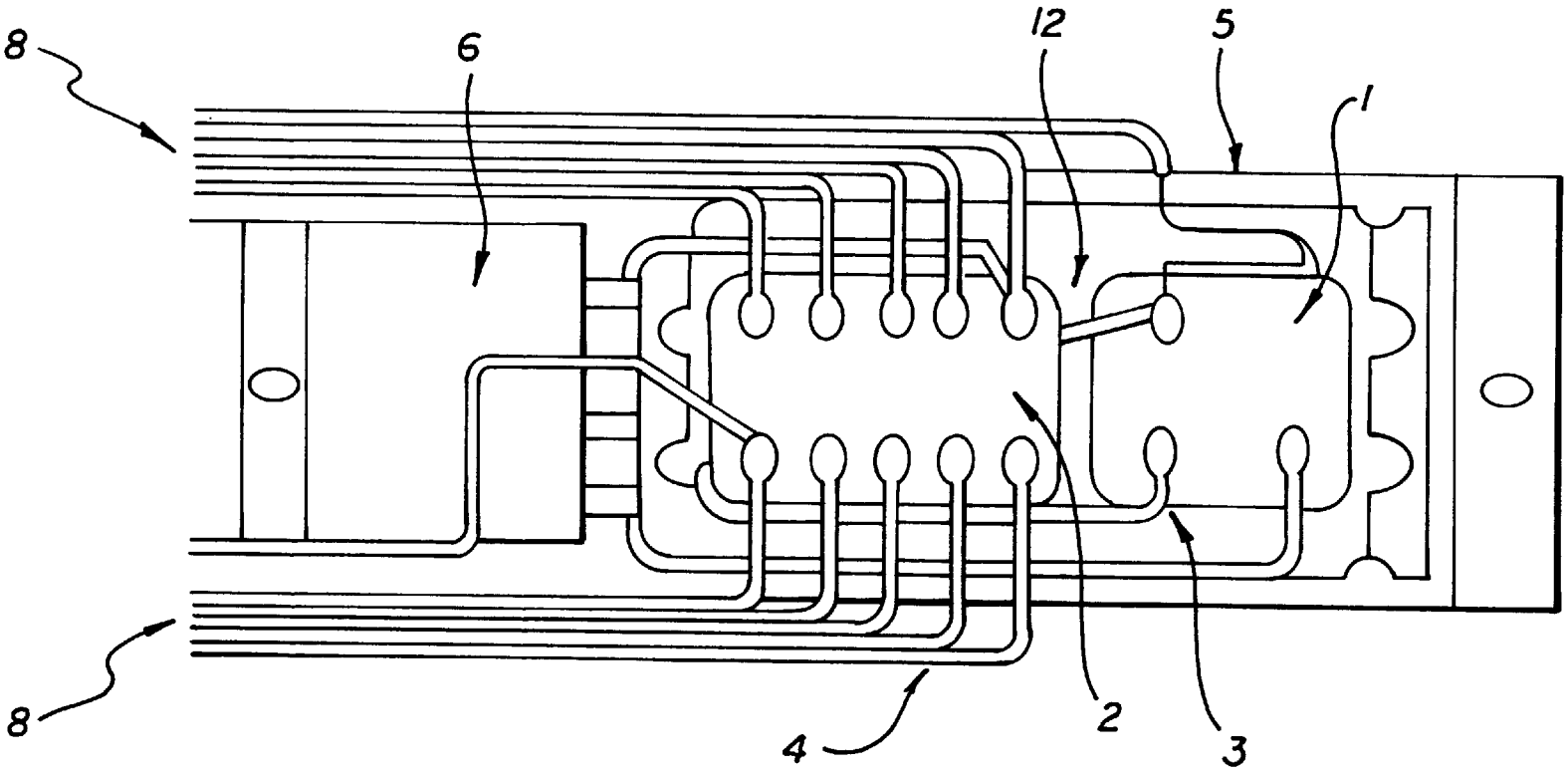
FIG. 3 is a plan view illustrating the wiring arrangement of a rapid start type fluorescent lamp stabilizer to which the invention can be applied.

FIG. 3 illustrates the wiring arrangement of a conventional rapid start type fluorescent lamp stabilizer to which the invention has been applied. The primary coil 1 the secondary coil 2 and the transfer coil 12 with iron core 3 are enclosed in a case 5 additionally with a condenser 6, a thermal protector and lead wires 8.

Figure 4A:
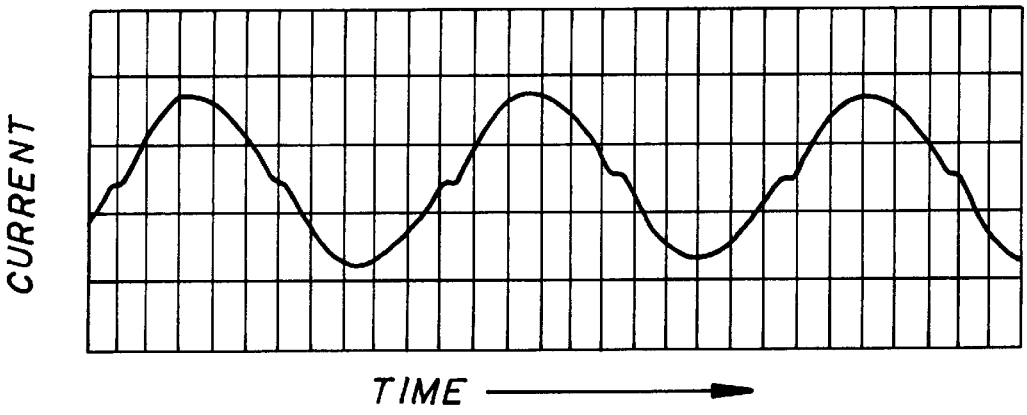
FIG. 4*a* is an illustration of a typical lamp current wave form generated by prior art stabilizers.
Figure 4B:
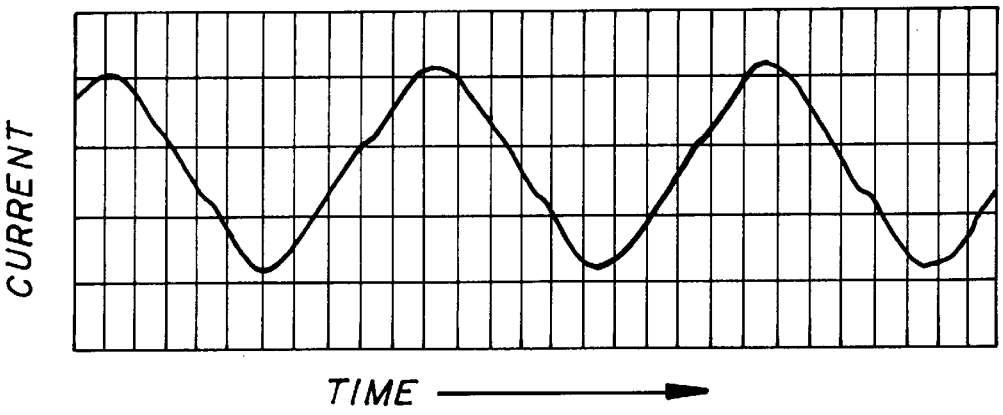
FIG. 4*b* is an illustration of the lamp current wave form for a stabilizer using the present invention.

FIG. 4*a* illustrates the harmonics existing in the secondary current wave form for the prior art. FIG. 4*b* illustrates the secondary current wave form in which the peak current is almost non existent as compared to the prior art method. In particular the spike which occurs prior to the peak of the main body of the current wave form is eliminated and the current wave form is made much more symmetrical.

Figure 5A:
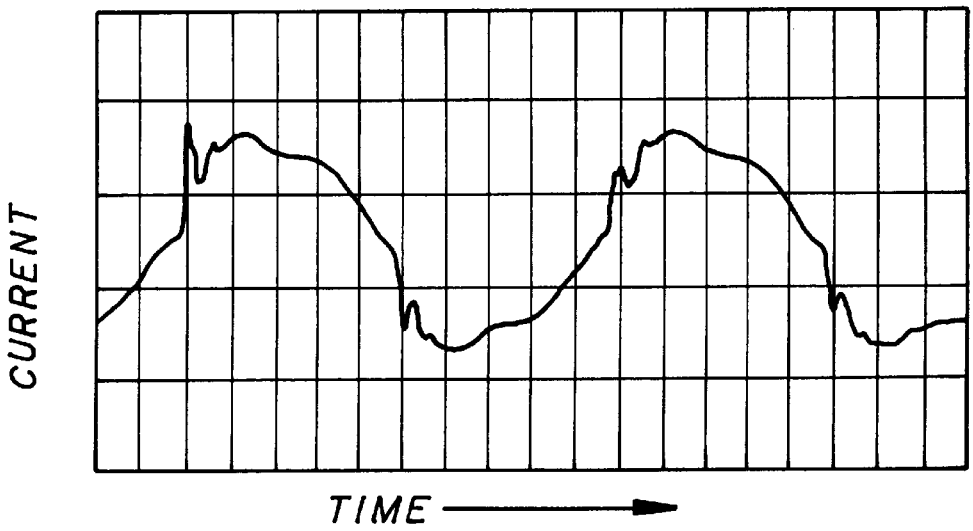
FIG. 5*a* is an illustration of a typical current wave form generated by primary side of the prior art stabilizers.
Figure 5B:
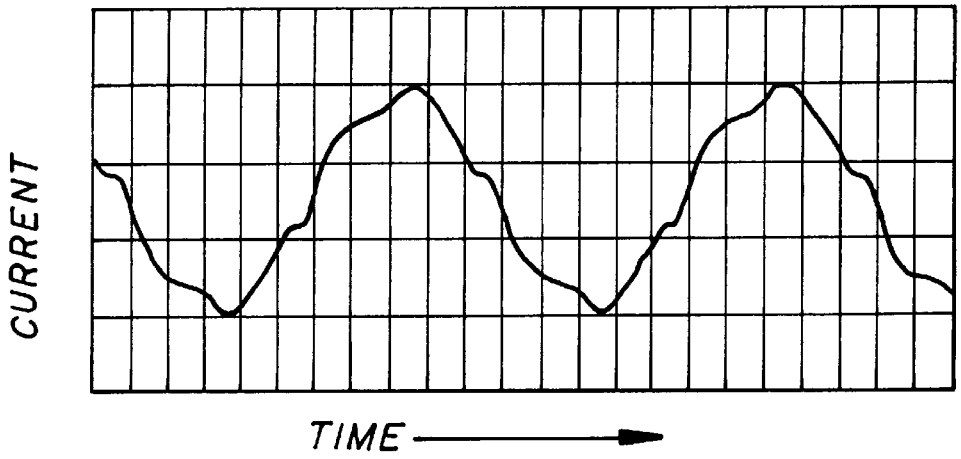
FIG. 5*b* is an illustration of the current wave form of the primary side of a stabilizer utilizing the invention.

FIG 5*a* illustrates the primary wave form according to the prior art indicating that distortion exists which can effect other electronic systems hooked to the same primary current source and can generate heat which must be dissipated in the system. Furthermore, the invention has the additional benefit of drastically reducing the power consumption of the system since the primary current value is lowered.

While the use of the invention reduces the absolute value of luminous intensity of the fluorescent light, due to the lowering of the maximum value of the secondary current, uniform brightness of the lumination is still maintained. Furthermore, by utilizing the invention, a lower light flux from an individual lamp is produced thereby reducing the glare and the requirement for high performance defusers in a work area served by fluorescent lamps. Thus, the use of the invention can reduce glare by lowering the cost of glare reduction methods and provide an additional benefit in reduced power utilized by the fluorescent lamp.

Another benefit of the present invention is its available high performance color lamps which has thus far proved unpopular because of the high costs of the lamps. By utilizing the invention with these color lamps a better quality illumination can be obtained by utilizing this more economical method of starting and maintaining the lamps in use. Thus, it may be seen that the present invention provides substantial benefits compared to conventional rapid start fluorescent lamp stabilizers.

The peak current value is reduced thereby reducing harmonics without distorting the secondary current. Distortion in the primary current wave form is also reduced. The radio frequency interference is substantially reduced by use of this method compared to other systems and the power saving is on the order of 35 to 45 percent compared to other systems. The decreased power consumption and improved wave form quality of the primary current also result in lower temperature of the ballast system and a resulting decrease in the cooling required for the stabilizer system. All of these benefits result in increased life spans for the fluorescent lamp and stabilizer as well as the surrounding electronic components and associated systems. While the invention has been described in the context of a four lamp system, it will be evident that it may be applied equally to any fluorescent light system utilizing the rapid starting fluorescent lamp stabilizer system.

While one particular form of the invention has been described, it will be apparent to those skilled in the art that various modifications can be made without departing from the spirit and scope of the invention be limited except as by the appended claims.

I claim:

1. In a low power consumption stabilizer of the type which includes a primary winding, a secondary winding, a fluorescent lamp, and a rated lamp current, the improvement which comprises:

an impedance means for reducing the current in the secondary winding;

wherein the peak current value is substantially eliminated, thereby substantially reducing the harmonic distortion in the stabilizer;

wherein the filament voltage of the lamp is maintained substantially constant, thereby maintaining substantially uniform brightness of the lamp; and wherein said secondary winding has turns, and said impedance means is an increased number of turns in the secondary winding, said increased number being in addition to the number of turns which provides the rated lamp current.

2. The stabilizer of claim 1 wherein said impedance means reduces the current in the secondary winding to less than 90 percent of the rated lamp current.

3. The stabilizer of claim 2 wherein the secondary current is reduced to no less than 40 percent of the rated lamp current.

4. The stabilizer of claim 1 wherein said reduced current in the secondary winding is about 65 percent of the rated lamp current.

5. The stabilizer of claim 4, further comprising a plurality of said lamp and a plurality of said secondary winding, each said secondary winding configured to reduce the secondary current to about 65 percent of the rated lamp current.

6. In a method of manufacturing a fluorescent lamp stabilizer, said stabilizer including a primary circuit, a secondary circuit, a fluorescent lamp, and a rated lamp current, said method comprising:

increasing the impedance in the secondary circuit to substantially eliminate the peak current value and to substantially avoid harmonic distortion in the circuits: and constructing the stabilizer circuits to maintain the filament voltage of the fluorescent lamp substantially constant during operation, thereby maintaining substantially uniform brightness of the lamp, wherein the secondary circuit includes a winding with turns, and said impedance increasing step includes increasing the number of turns in said winding, said increased number of turns being in addition to the number of turns which provides the rated lamp current.

7. The method of claim 6 wherein said impedance increasing step decreases the current in the secondary circuit to less than 90 percent of the rated lamp current.

8. The method of claim 7 wherein the secondary circuit current is reduced to no less than 40 percent of the rated lamp current.

9. The method of claim 6 wherein said impedance increasing step reduces the current in the secondary circuit to about 65 percent of the rated lamp current.

10. A method for avoiding harmonics and distorted wave forms in a fluorescent lamp stabilizer, said stabilizer including a primary coil, a secondary coil and a rated lamp current, said coils having windings and said rated lamp current being determined by the ratio of the number of windings in the primary coil to the number of windings in the secondary coil, said method comprising:

operating said secondary coil with a number of windings greater than the number of windings which provides the rated lamp current;

eliminating the peak current value; and maintaining the filament voltage of the fluorescent lamp substantially constant.

11. The method of claim 10 wherein the current in the secondary coil is reduced to about 65 percent of the rated lamp current.

* * * * *

UNITED STATES PATENT AND TRADEMARK OFFICE

CERTIFICATE OF CORRECTION

PATENT NO. : 6,100,651

DATED : Aug. 8, 2000

INVENTOR(S) : Hitoshi Ohtsuka

It is certified that error appears in the above-identified patent and that said Letters Patent is hereby corrected as shown below:

Column 4, line 8, before "high performance", " add --for use with--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*